United States Patent [19]

Redolfi

[11] Patent Number: 4,639,903

[45] Date of Patent: Jan. 27, 1987

[54] UNDERWATER SOUND DELIVERY SYSTEM

[76] Inventor: Michel Redolfi, c/o CIRM, 33 Avenue Jean Medecin, 0600 Nice, France

[21] Appl. No.: 553,527

[22] Filed: Nov. 21, 1983

[51] Int. Cl.[4] ..... H04R 1/44

[52] U.S. Cl. ..... 367/131; 367/142; 367/173

[58] Field of Search ..... 367/131, 132, 142, 157, 367/165, 173; 441/12; 181/139, 140, 142; 116/27, 137 R; 340/384 E, 384 R, 387

[56] References Cited

U.S. PATENT DOCUMENTS

| | | | |
|---|---|---|---|
| 2,164,858 | 7/1939 | West | 367/142 |
| 3,100,291 | 8/1963 | Abbott | 367/157 |
| 3,310,129 | 3/1967 | Sawyer | 116/27 |
| 3,391,385 | 7/1968 | Lubell | 367/157 |
| 3,718,897 | 2/1973 | Abbott | 367/157 |

*Primary Examiner*—Richard A. Farley

*Attorney, Agent, or Firm*—Charmasson & Holz

[57] ABSTRACT

A sound transducer mounted inside a buoy for broadcasting sounds both underwater and above water. The buoy is a hollow sphere which admits water; but whose buoyancy is maintained by air-filled balls or a bladder captured inside.

9 Claims, 4 Drawing Figures

FIG. 1
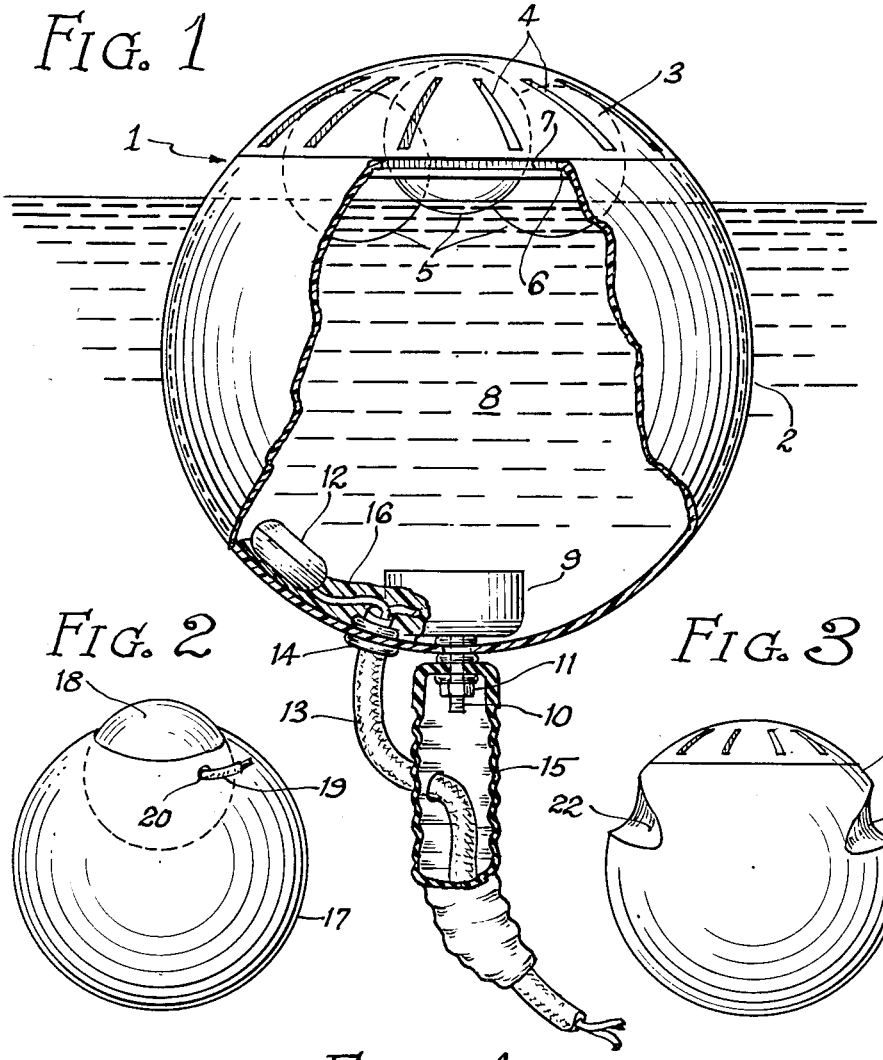
FIG. 2
FIG. 3
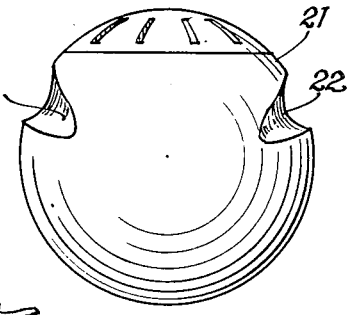
FIG. 4
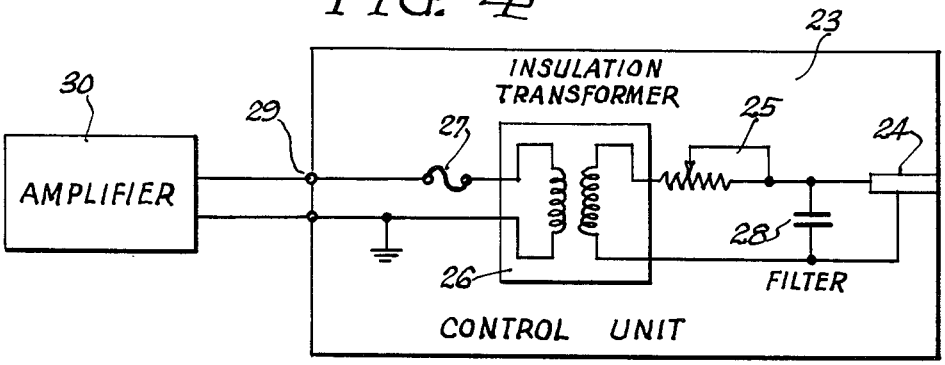

UNDERWATER SOUND DELIVERY SYSTEM

FIELD OF THE INVENTION

This invention relates to sound delivering equipment and more particularly to loudspeakers designed to operate under water.

BACKGROUND OF THE INVENTION

Sound transmission and broadcasting underwater has been used in scientific experiments, industrial applications and in the aquatic sports and entertainment field for the transmission of voice instructions to athletes or artists performing underwater. The most common type of underwater sound delivery systems uses piezoelectric transducers, examples of which are disclosed in U.S. Pat. Nos. 3,100,291 and 3,718,897 to Abbott and 3,391,385 to Lubbell. This type of transducer tends to be heavy, has a very poor response to frequencies below 300 Hz, and is usually very expensive.

There is a need for a high-fidelity sound system capable of operating underwater as well as above.

SUMMARY OF THE INVENTION

The principal object of this invention is to provide and inexpensive, high-fidelity sound-delivering system which can be mounted on a floating buoy to deliver sound both underwater and above.

Another object of this invention is to provide a sound delivery system whose ability to broadcast below and above water can be quickly apportioned.

A further object of this invention is to provide an underwater and above water sound delivery system which can be quickly installed in existing aquatic facilities.

These and other useful objects are achieved by packaging a sound transducer into a sphere which admits water but is kept floating by a plurality of air-filled balls or an air filled bladder captured therein. Electrical insulation of the power amplifier from the sound delivering buoy is accomplished by means of a transformer.

BRIEF DESCRIPTION OF THE DRAWING

FIG. 1 is a front elevational view of the sound delivering buoy shown partially submerged with cutouts exposing the internal arrangements.

FIG. 2 shows the buoy using an inflatable bladder or balloon.

FIG. 3 illustrates an alternate embodiment of the buoy with hemispherical indentations to facilitate handling.

FIG. 4 is a schematic of the control unit.

DESCRIPTION OF THE PREFERRED EMBODIMENT OF THE INVENTION

In the preferred embodiment of the sound delivery system, the loud speaker 1 illustrated in FIG. 1 comprises a hollow sphere 2 made of semi-rigid plastic material and having a removable lid 3 forming the upper part of the sphere. The lid 3 has a plurality of meridianal slits 4 and is held in place by detent action of the sphere rim 6 engaging a groove 7 along the lower periphery of the lid. The sphere 2 is partially submerged and almost filled with water 8. It is kept afloat by a plurality of air-filled balls 5 of the type used for practicing table-tennis.

Inside the sphere 2, a dynamic sound transducer 9 of the type described in U.S. Pat. Nos. 3,430,007 to Thielen and 3,524,027 to Thruston et al. has its diaphragm bolted to the wall of the sphere by means of threaded stem 10 and nut 11. A second piezoelectric high frequency transducer 12 is bonded to the inside surface of the sphere 2. Electrical wiring 13 from the transducer 9, 12 exits the sphere 2 through a grommeted hole 4 and passes through a strain-relief sleeve 15 whose upper extremity is secured to the stem 10. The transducer wiring connections are imbedded in a dab of silicone glue 16 which provides water insulation.

The mechanical vibration of the transducers 9, 12 are imparted to the walls of the sphere 2 which in turn generate sound waves directed both under and above water. The amount of sound energy expended throught the water or in the air can be apportioned by adjusting the buoyancy of the sphere 2. This can be done by adjusting the volume of water admitted into the sphere or by increasing or decreasing the number of balls 5 captured inside it.

FIG. 2 illustrates an alternate embodiment 17 of the sphere where the buoyant balls 5 and lid 3 have been replaced by an inflatable balloon 18. The stem 19 of the balloon is captured through a small hole 20 in the side of the sphere 17. The level of floatation 17 can be controlled by inflating or deflating the balloon 18.

FIG. 3 illustrates yet another configuration 21 of the sphere in which the sides have been altered by two hemispherical indentations 22. In the case of a small sphere, the indentations 22 facilitate the handling of the sphere with one hand. In larger embodiments of the loud speaker, with a sphere diameter of preferably 30 centimeters (12 inches), the indentations 22 facilitate the grabbing of the sphere between the crossed legs of a swimmer, so that the vibration generated by the unit will be transmitted to the body of the swimmer providing a gentle soothing massaging action in synchronization with the music being played through the system.

The wiring of the transducers 9 and 12 is connected to the output 24 of the control unit 23 which includes a volume control rheostat 25, an insulation transformer 26, a fuse 27 and a filtering capacitor 28. The input 29 of the control unit 23 receives the output signal of an audioamplifier 30. The output section of the control unit located beyond the insulation transformer 26 could be packaged in a compact waterproof enclosure to be used above or under water.

The device described above constitutes a versatile sound delivery system which can be used in a variety of environments for either scientific, commercial or entertainment purposes.

While the preferred embodiment of the invention and a few alternate configurations have been described, other modifications and embodiments may be devised without departing from the spirit of the invention and the scope of the appended claims.

What is claimed is:

1. An underwater sound deliver apparatus which comprises:

a hollow sphere partially submerged in water;

said sphere being truncated to form an opening;

at least one sound transducer attached to the submerged portion of the sphere; and buoyant means for maintaining a portion of the sphere above water when water is admitted therein.

2. The apparatus claimed in claim 1 wherein said buoyant means comprise:

at least one buoyant body;

means for capturing said body within said sphere.

3. The apparatus claimed in claim 2 wherein:

said buoyant body is a air-filled ball;

said means for capturing is a permeable cover closing said opening.

4. The apparatus claimed in claim 2 wherein:

said buoyant body is a air-filled balloon; and said means for capturing comprises the stem of said balloon being engaged through a hole in side of said sphere.

5. The apparatus claimed in claim 2 wherein said transducer comprises a dynamic sound transducer with the diaphragm of said transducer attached to the internal surface of said sphere.

6. The apparatus claimed in claim 5 wherein said sphere has two, symmetrically arranged hemispherical indentations in its outside surface.

7. The apparatus claimed in claim 5 which further includes a piezoelectric, high frequency transducer bonded to the internal surface of said sphere.

8. The apparatus claimed in claim 3 which comprises a plurality of table-tennis balls captured within said sphere.

9. An underwater sound delivery apparatus which comprises:

a hollow sphere truncated to form an opening;

means for imparting vibrations to the internal surface of said sphere in response to electrical signals; and at least one air-filled body captured within said sphere.

* * * * *